United States Patent [19]

Calvert

[11] Patent Number: 4,869,052

[45] Date of Patent: Sep. 26, 1989

[54] PACKAGING MACHINE

[75] Inventor: Rodney K. Calvert, Dunwoody, Ga.

[73] Assignee: The Mead Corporation, Dayton, Ohio

[21] Appl. No.: 269,898

[22] Filed: Nov. 10, 1988

[51] Int. Cl.[4] ..... B65B 5/06; B65B 7/20; B65B 43/26; B65B 51/02

[52] U.S. Cl. ..... 53/566; 53/258; 53/284; 53/374; 53/383

[58] Field of Search ..... 53/258, 284, 374, 383, 53/458, 541, 543, 566, 574

[56] References Cited

U.S. PATENT DOCUMENTS

| | | | |
|---|---|---|---|
| 2,678,151 | 5/1954 | Geisler | 53/543 X |
| 2,831,300 | 4/1958 | Schroeder | 53/374 |
| 2,906,075 | 9/1959 | Vogel | 53/566 |
| 2,993,314 | 7/1961 | Havemann et al. | 53/566 X |
| 3,530,640 | 9/1970 | Hoffman | 53/574 X |
| 3,584,434 | 6/1971 | Ellis | 53/541 |
| 3,589,096 | 6/1971 | Podvin | 53/374 X |
| 4,517,791 | 5/1985 | Focke | 53/566 |
| 4,519,181 | 5/1985 | Sherman et al. | 53/383 X |

*Primary Examiner*—Robert L. Spruill
*Assistant Examiner*—Linda B. Johnson
*Attorney, Agent, or Firm*—Rogers & Rogers

[57] ABSTRACT

Collapsed sleeve type article containers are withdrawn in sequence from a hopper by suction cup means which then holds each carton at a loading station for an interval of time during which a plurality of articles are inserted through an open end of each container sleeve. Minor end closing flaps of the loaded container are moved into closed positions while the container is held stationary at the loading station. Thereafter the loaded container is moved out of the loading station and its major end flaps are closed and secured in closed position.

7 Claims, 4 Drawing Sheets

PACKAGING MACHINE

TECHNICAL FIELD

This invention pertains to a method and apparatus for packaging a plurality of articles such as primary packages in a sleeve type container.

BACKGROUND ART

U.S. Pat. No. 4,237,673 issued Dec. 9, 1980 and owned by the assignee of this invention discloses and claims a high speed packaging machine for loading primary articles through both ends of a sleeve type container. In this patent, the apparatus operates continuously without intermittent movement and is thus well adapted for high speed, high capacity operation.

SUMMARY

According to this invention in one form, collapsed sleeve type article containers are withdrawn from a hopper in sequence and are held in set up condition at a loading station by vertically reciprocable means and loading means engages and moves a plurality of articles into each container through an open end thereof while such container is held at the loading station by said vertically reciprocal means.

According to a feature of the invention, conveyor means is disposed at a level somewhat below the loading station and transmits a series of articles toward the loading station and elevator means receives a plurality of articles from the conveyor means and raises such articles to the level of the loading station following which the articles are pushed into an open end of the container.

BEST MODE OF CARRYING OUT THE INVENTION

Figure 4:
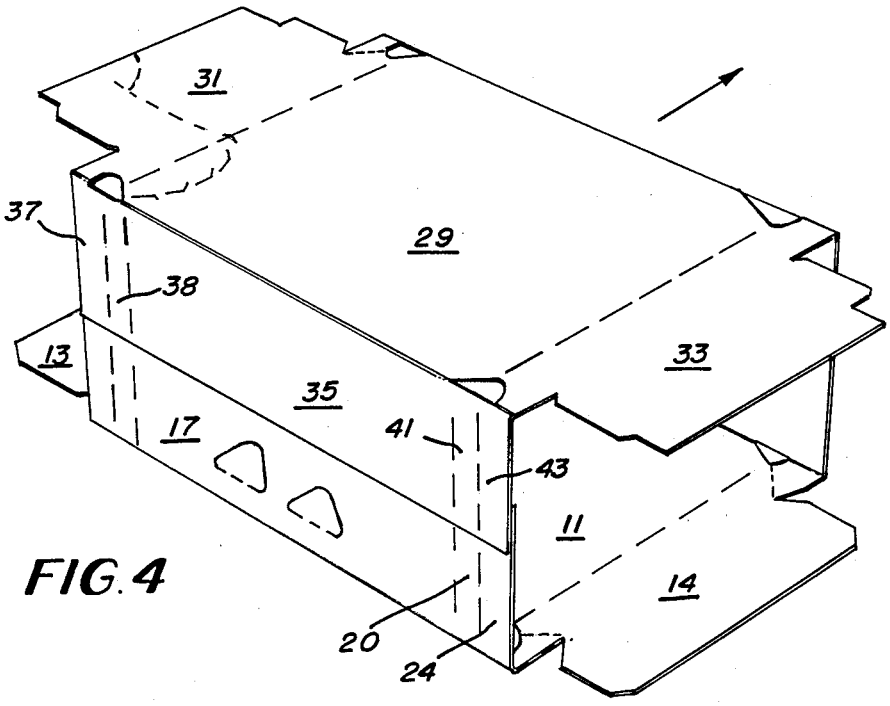
FIG. 4 is a perspective view of a sleeve type container to which this invention is applicable and which shows the container set up with its end closure panels shown in open position.
Figure 5:
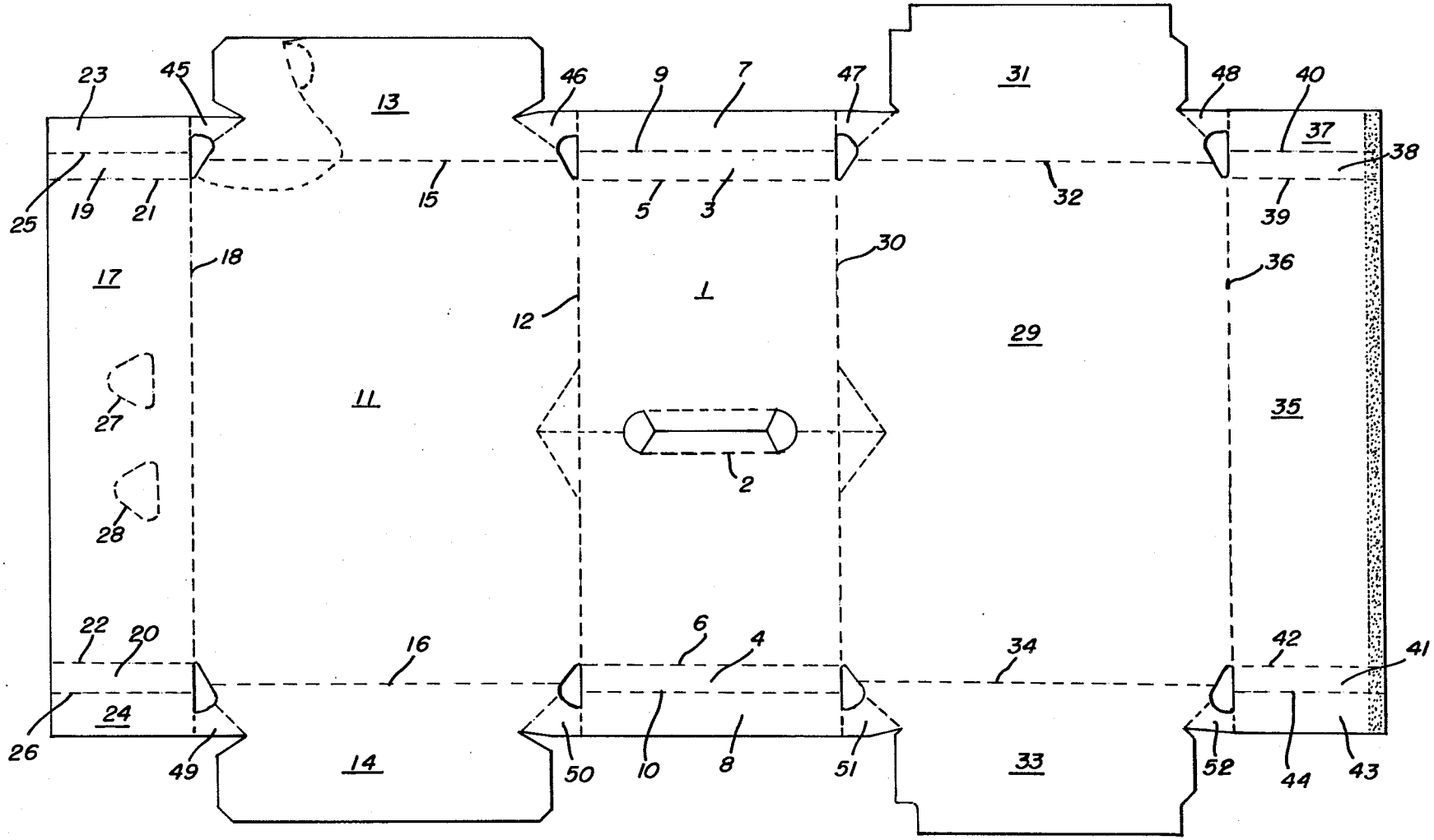
FIG. 5 is a plan view of a blank from which the structure shown in FIG. 4 is formed.

With reference to FIGS. 4 and 5, the numeral 1 designates the top panel of the container in which handle structure 2 is formed. Handle structure 2 may take any suitable form such for example as that disclosed and claimed in U.S. Pat. No. 4,558,816 issued Dec. 17, 1985 and owned by the assignee of this invention. Bevelled panels 3 and 4 are foldably joined to the end edges of top wall 1 along fold lines 5 and 6 respectively. End panels 7 and 8 are foldably joined to bevelled panels 3 and 4 respectively along fold lines 9 and 10.

These bevelled panels 3 and 4 may take the form shown and claimed in U.S. Pat. No. 4,216,861 issued Aug. 12, 1980 and owned by the assignee of this invention. As used herein, the term minor end closing flap is applied to end panels such as 7 and 8.

Side wall 11 is foldably joined to top wall 1 along fold line 12. Major end closing flaps 13 and 14 are foldably joined to side wall 11 along fold lines 15 and 16 respectively. Flaps 13 and 14 are herein designated by the term major end closing flaps.

Bottom lap panel 17 is foldably joined to side wall 11 along a fold line 18 and bevelled panels 19 and 20 are foldably joined to bottom lap panel 17 along fold lines 21 and 22 respectively. Minor end closing flaps 23 and 24 are foldably joined to bevelled corner panels 19 and 20 along fold lines 25 and 26 respectively.

For some applications of the invention, apertures 27 and 28 may be formed in lap panel 17 for receiving machine elements if desired.

On the other side of the blank, side wall 29 is foldably joined to top wall 1 along fold line 30 and major end closing flap 31 is foldably joined to side wall 29 along fold line 32. Similarly, major end closing flap 33 is foldably joined to an end of side wall 29 along fold line 34.

Bottom lap panel 35 is foldably joined to side wall 29 along fold line 36 and minor end closing flaps including end panels 37 and 43 are formed at one end of bottom lap panel 35. Bevelled corner panel 38 is foldably joined to bottom lap panel 35 along fold line 39 and is foldably joined to end panel 37 along fold line 40.

At the other end of the lap panel 35, bevelled corner panel 41 is foldably joined to lap panel 35 along fold line 42 and to end panel 43 along fold line 44.

Web panels 45–52 inclusive are formed at each corner at each end of the container and function in known manner.

In order to form the open ended sleeve container as shown in FIG. 4 from the blank shown in FIG. 5, an application of glue is made to bottom lap panel 35 and to the minor end closing flaps and bevelled corner panels at each end of panel 35 following which side wall 11 and bottom lap panel 17 are elevated and folded toward the right along fold line 12. Thereafter bottom lap panel 35 is elevated and folded toward the left along fold line 36 to form a collapsed container. This operation causes the lap panels 17 and 35 to be secured together as shown in FIG. 4.

As disclosed herein, the minor end closing flaps and the major end closing flaps are manipulated into end closing positions and are secured in such positions by an application of glue in a manner which is well known. This invention is not limited to use in conjunction with glued containers but is applicable as well to containers in which the end closing flaps are secured together by locks such as are disclosed and claimed in U.S. Pat. No. 3,955,748 issued May 11, 1976.

Figure 1:
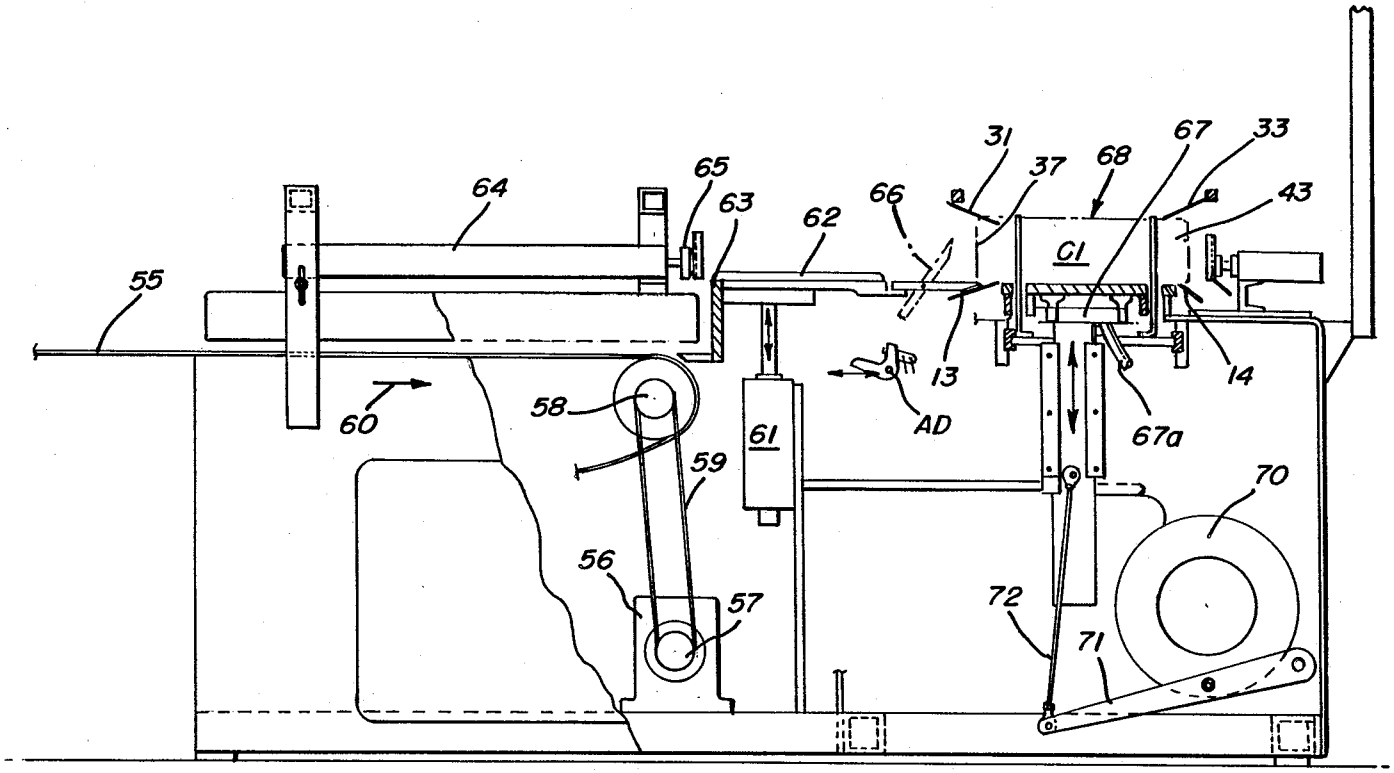
FIG. 1 is a side view of a machine formed according to this invention.
Figure 2:
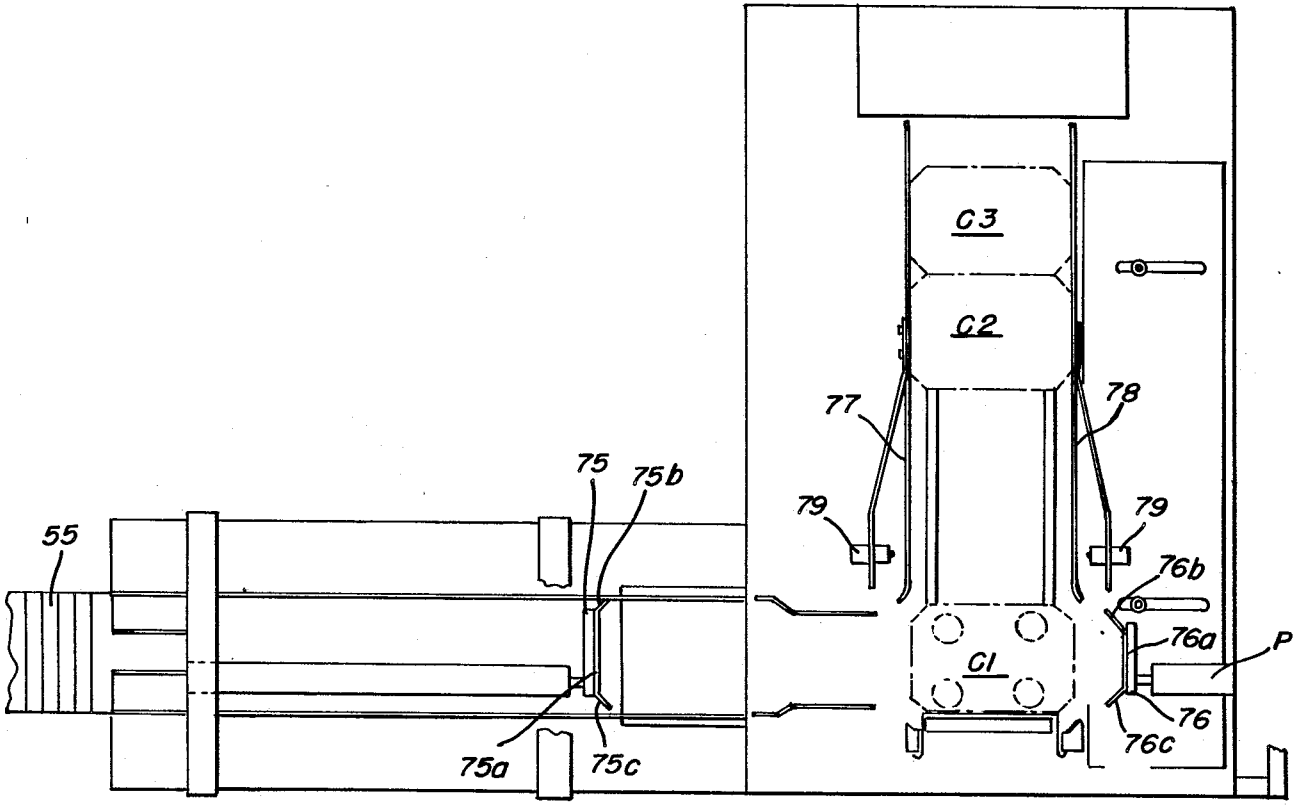
FIG. 2 is a plan view of the arrangement shown in FIG. 1.

With reference to FIGS. 1 and 2, conveyor means 55 is driven by a motor driven gear box 56, which imparts rotary motion to pulley 57 and to pulley 58 by virtue of endless driving belt 59 which results in movement of the working reach of conveyor reach 55 from left to right as indicated by the arrow 60.

Vertically reciprocal elevator means 61 normally is arranged with its article support platform 62 disposed in the down position at the same level as the working reach of conveyor means 55 so that articles fed by conveyor means 55 are loaded onto platform 62 and into engagement with article detector AD which signals in known manner the fact that the elevator is full after which the articles are elevated to the loading level of the loading station. Article arresting element 63 which is rigidly secured to platform 62 serves to arrest inward movement toward the right of subsequently arriving containers on conveyor means 55.

Figure 3:
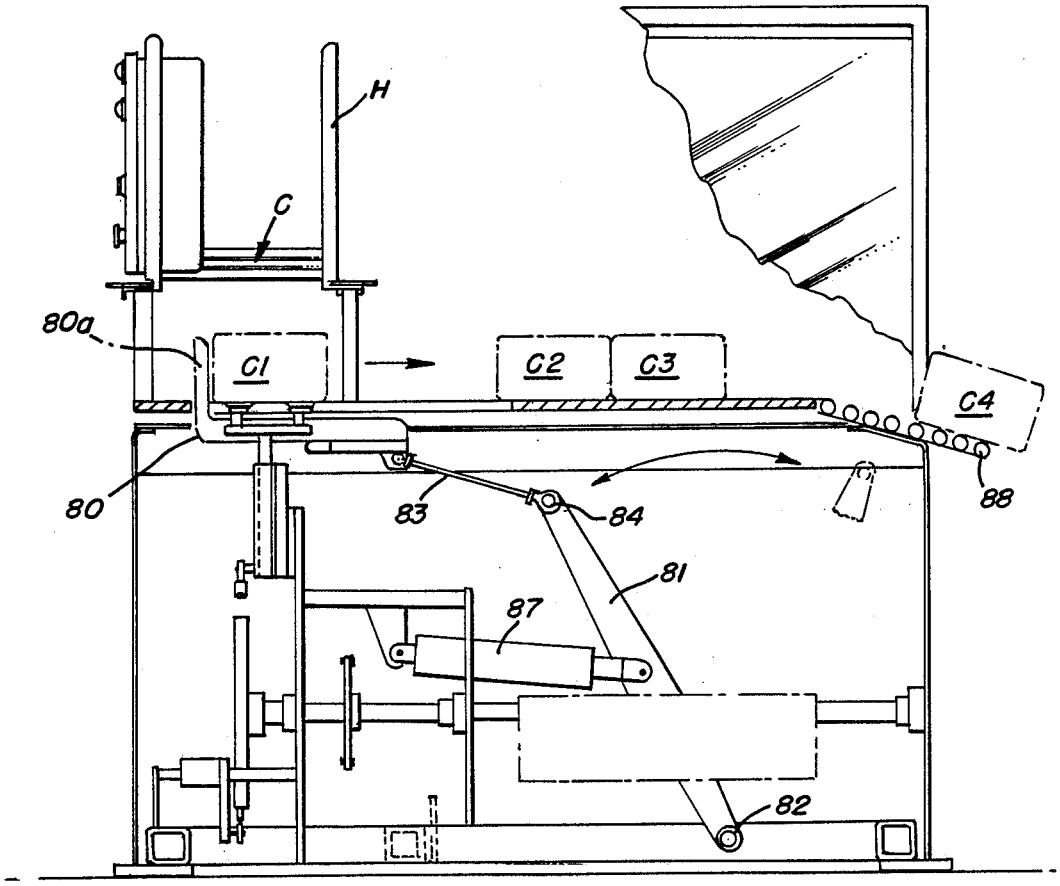
FIG. 3 is an end view of the apparatus shown in FIGS. 1 and 2.

Container C1 is held in the position shown in FIGS. 1, 2 and 3 for an interval of time by suction cup means 67 which function in known manner to engage the lowermost container such as C1 disposed in hopper H in collapsed condition. Downward movement of vertically reciprocal suction cup means 67 withdraws the lowermost container from its lowermost position in hopper H and downward movement of this container causes upstanding part 80a of sled 80 to engage the container at the corner defined by fold line 36 and results in a set up condition of the container designated C1 at the loading station designated generally by numeral 68. From FIG. 1, it is apparent that the major end flaps such as 31, 13, 33 and 14 are open as well as the minor end closing flaps including flaps 37 and 43 are also open.

Thus articles disposed atop platform 62 are loaded through the open end of container C1 by loading means 64 which includes reciprocal pusher means 65. Movement from left to right of pusher means 65 forces the articles disposed on platform 62 across the pivotally mounted panel 66 and into the open ended sleeve C1. When disposed in its dotted line position, pivotally mounted panel 66 allows unimpeded passage of the container end flaps as the container is drawn down into the loading station 68 while platform 62 is disposed in its down position. Pivotally mounted panel 66 is rotated from its dotted line position to its full line position as shown in FIG. 1 as the articles are pushed from platform 62 and as also shown in FIG. 1 panel 66 engages and holds flap 13 down to prevent that flap from interfering with the movement of the incoming articles.

As explained, the container C1 is stationary and is held in the position shown in FIG. 1 by the suction cup means 67 due to the fact that its driving cam 70 and its operating levers 71 and 72 are stationary for an interval of time so that vertically reciprocal motion of suction cup means 61 is arrested for a short interval so as to hold the suction cup means 67 in the position shown in FIG. 1 during the loading operation.

The minor end closing flaps are moved into closed position upon completion of the loading of articles into a container such as C1. This folding operation is effected by horizontally reciprocal minor flap folding elements 75 and 76. Element 75 is mounted on reciprocal pusher means 65 and includes a transverse central support panel 75*a* and bevelled panels 75*b* and 75*c*. These bevelled panels force the minor end closing flaps into a position astride the corners of the carton C1. Similarly minor flap folding element 76 is mounted on pusher means P and includes a transverse central support panel 76*a* and a pair of bevelled panels 76*b* and 76*c* which engage the corresponding minor end closing flaps at the right hand end of the container C1 to move those flaps into closed positions. Following this folding operation, suction pressure in line 67*a* is released and container C1 is moved out of the loading station 68. The container C1 is moved from left to right as shown in FIG. 3 by sled 80 whose operation from left to right is effected by link 81 pivotally mounted at fixed pivot 82 and pivotally connected to link 83 at pivot 84. To and for movement of this structure is effected by pneumatically operable fluid motor 87 so that finished set up and loaded cartons are moved off and out of the machine on the conveyor 88.

The major end closing flaps are manipulated into closed positions as the container is moved away from the loading station 68 by flap closing guides 77 and 78 and are glued in face contacting relation at each end of the container by means of glue applicators 79 disposed on either side of the path of movement to complete the formation of the container.

I claim:

1. A packaging machine for setting up and loading collapsed sleeve type article containers, said machine comprising a hopper in which collapsed containers are disposed, vertically reciprocal means for withdrawing said containers in sequence from said hopper and for holding each of said containers in set-up condition at a loading station for an interval of time, and loading means for engaging and moving a plurality of articles into each container through an open end thereof while such container is being held in said loading station by said vertically reciprocal means, each of said containers including oppositely disposed minor end closing flaps at each end and horizontally reciprocal minor flap folding elements for engaging and folding such minor flaps inwardly while the container is being held at said loading station and one of said minor flap folding elements being mounted on and movable with a part of said loading means.

2. A packaging machine according to claim 1 wherein the other minor flap folding element is disposed at the end of the container which is opposite from said loading.

3. A packaging machine according to claim 2 wherein said other flap folding element opposes the force imparted by said one minor flap folding element to articles being loaded to prevent over travel of the articles being loaded.

4. A packaging machine according to claim 1 wherein said one minor flap folding element includes a transverse central support panel and a pair of bevelled minor flap engaging end panels mounted at the ends of said support panel.

5. A packaging machine for setting up and loading collapsed sleeve type article containers, said machine comprising a hopper in which collapsed containers are disposed, vertically reciprocal means for withdrawing said containers in sequence from said hopper and for holding each of said containers in set-up condition at a loading station for an interval of time, loading means for engaging and moving a plurality of articles into each container through an open end thereof while such container is being held in said loading station by said vertically reciprocal means, conveyor means disposed at a level somewhat below said loading station for transporting a series of articles toward said loading station, elevator means for receiving a plurality of articles from said conveyor means and for raising such articles to the level of said loading station, reciprocal pusher means for engaging a plurality of articles disposed on said elevator means at the level of said loading station and for pushing such articles into an open end of a container being held at said loading station, and a pivotally mounted panel interposed between said elevator means and said loading station and means for maintaining said panel in a position so that an end thereof is disposed adjacent the loading station and which in its upper position allows extended container end flaps to clear the pivotally mounted panel during movement of the container into the loading station and said pivotally mounted panel while disposed horizontally due to force imparted thereto by incoming articles serves as support for the articles during a loading operation.

6. A packaging machine according to claim 5 wherein said pivotally mounted panel engages and holds one of said end closing flaps in a position out of the path of movement of articles while being loaded into said open end of said container and while said elevator means is in its up position.

7. In a packaging machine including a hopper for holding collapsed containers having end closing flaps, means for withdrawing a container from said hopper and for holding said container in set up condition at a loading station with its end closing flaps extended, the improvement comprising a pivotally mounted panel including means maintaining said panel in a tilted position to allow the extended end closing flaps of a container to clear said pivotally mounted panel during movement of the container into said loading station and said pivotally mounted panel being movable to a horizontal position due to the force imparted thereto by incoming articles to receive and convey articles into the container and to move an end closing flap out of the path of movement of articles being moved on said pivotally mounted panel and into the container.

* * * * *